US008656525B2

(12) United States Patent
Shi

(10) Patent No.: US 8,656,525 B2
(45) Date of Patent: Feb. 25, 2014

(54) SANITARY WARE OF ENVIRONMENTAL PROTECTION TYPE

(76) Inventor: Weidong Shi, Shanghai (CN)

( * ) Notice: Subject to any disclaimer, the term of this patent is extended or adjusted under 35 U.S.C. 154(b) by 807 days.

(21) Appl. No.: 12/854,657

(22) Filed: Aug. 11, 2010

(65) Prior Publication Data

US 2011/0247131 A1 Oct. 13, 2011

(51) Int. Cl.
*E03D 11/02* (2006.01)
*E03D 11/18* (2006.01)

(52) U.S. Cl.
USPC ..... 4/421

(58) Field of Classification Search
USPC ..... 4/420–442
See application file for complete search history.

(56) References Cited

U.S. PATENT DOCUMENTS 5,502,845 A * 4/1996 Hayashi et al. ..... 4/300
5,983,413 A * 11/1999 Hayashi et al. ..... 4/420
6,986,172 B2 * 1/2006 Hidetaka et al. ..... 4/425
7,263,727 B1 * 9/2007 Zhurin et al. ..... 4/300
8,185,975 B2 * 5/2012 McDaniel ..... 4/300.3
8,359,676 B2 * 1/2013 Richard et al. ..... 4/223
2006/0005310 A1 * 1/2006 Nakamura et al. ..... 4/420
2007/0199138 A1 * 8/2007 Zhurin et al. ..... 4/300

* cited by examiner

*Primary Examiner* — Lori Baker
(74) *Attorney, Agent, or Firm* — Muncy, Geissler, Olds & Lowe, P.C.

(57) ABSTRACT

A sanitary ware of environmental protection including a sanitary ware body; wherein a sewage cavity is provided at the bottom of the sanitary ware body, and a sewage draining exit is arranged on the bottom of the sewage cavity; a liquid channel and a foam channel that are not in communication with each other are provided on the sanitary ware body, and the liquid channel and the foam channel are ceramic structure integrally formed in the sanitary ware body; the sanitary ware body is further provided with a water inlet and a foam inlet, the water inlet is in communication with the liquid channel; the liquid channel is provided with liquid outlets; a deodorizing device adapted to be closed and opened is provided at the bottom of the sewage draining exit.

13 Claims, 8 Drawing Sheets

SANITARY WARE OF ENVIRONMENTAL PROTECTION TYPE

CROSS-REFERENCE TO RELATED APPLICATIONS

This application claims the benefit of a PCT International Application No. PCT/CN2010/000487, "ECO-FRIENDLY SANITARY ENVIRONMENT", filed on Apr. 13, 2010, by Weidong Shi, the contents of which are incorporated herein by reference in their entirety.

TECHNICAL FIELD OF THE INVENTION

The present invention relates to the field of the sanitary ware, and in particular to a sanitary ware of environmental protection type.

BACKGROUND OF THE INVENTION

Many cities are in lack of water, while traditional toilet bowl consumes large amounts of water, which results in wastage of water resource, especially for toilets in public places. Moreover, bad smell will escape from the sewage draining passage of the toilet bowl, splash may also occur, and further sewage may stick on the surface of the toilet bowl easily.

To overcome the above problems, a sanitary ware of foam sealing type is developed. Foam is generated to flush the sanitary ware such that the urine and the excrement will be discharged quickly without sticking on the sanitary ware. The foam will prevent the sewage from splashing and the bad smell from escaping out. However, there are still some problems. For instance, a metal pipe is normally added for transporting the foam, the pipe will get blocked due to the long-term corrosion, the foam supplying speed is low, and further the distributing of the foam is not even.

BRIEF SUMMARY OF THE INVENTION

It is an object of the present invention to provide a sanitary ware which is capable of providing foam and liquid automatically and quickly, and easily for maintenance.

It is a further object of the present invention to provide a sanitary ware for urinating that is capable of providing foam and liquid automatically and quickly, and easily for maintenance.

According to an aspect of the present invention, a sanitary ware comprises:

a sanitary ware body;

wherein a sewage cavity is provided at the bottom of the sanitary ware body, and a sewage draining exit is arranged on the bottom of the sewage cavity;

the sanitary ware body has a liquid channel and a foam channel that are not communicated with each other, the liquid channel and the foam channel being ceramic structure integrally formed in the sanitary ware body;

the sanitary ware body is further provided with a water inlet and a foam inlet, the water inlet being communicated with the liquid channel, and the foam inlet being communicated with the foam channel;

the liquid channel is provided with liquid outlets, the foam channel is provided with foam outlets, the liquid outlets and the foam outlets are arranged on the upper inner wall of the sewage cavity;

a deodorizing device adapted to be closed and opened is provided at the bottom of the sewage draining exit.

According to a further aspect of the present invention, a sanitary ware for urinating comprises:

a sanitary ware body;

wherein the sanitary ware body is provided with a sewage cavity and a foaming tank, the sewage cavity is arranged at the front bottom of the sanitary ware body, while the foaming tank is arranged in the rear portion of the sewage cavity;

the sewage cavity is provided inside with a foam channel communicated with the foam outlet of the foaming tank, the foam channel extends to the bottom trough along two sides of the sewage cavity, and the foam channel has foam outlets around the bottom trough and located at the inner wall of the bottom trough;

the sewage cavity is provided on the top with a transversal liquid channel, and the liquid channel has water outlets on the inner wall of the sewage cavity.

It can be seen from the above that in the present invention, the liquid channel in the sanitary ware body and the foam channel are not communicated with each other. When in use, the water flushing and the foam flushing are performed through different channels such that the insufficient foam and poor cleaning result caused by the arrangement that water and the foam are supplied through one channel. The sanitary ware of this invention has the advantages that the liquid and the foam are flushed in a fast speed and the pipe obstructing will not occur easily.

Furthermore, the foam channel and the liquid channel are both integrally formed in the sanitary ware, which prevents the channels from obstruction caused by corrosion as that may occur in the prior art. The sanitary ware thus has longer lifetime and is more stable.

BRIEF DESCRIPTION OF THE SEVERAL VIEWS OF THE DRAWING

For a more complete understanding of the present invention, and for further advantages thereof, reference is now made to the following description taken in conjunction with the accompanying drawings in which.

DETAILED DESCRIPTION OF THE INVENTION

Figure 1:
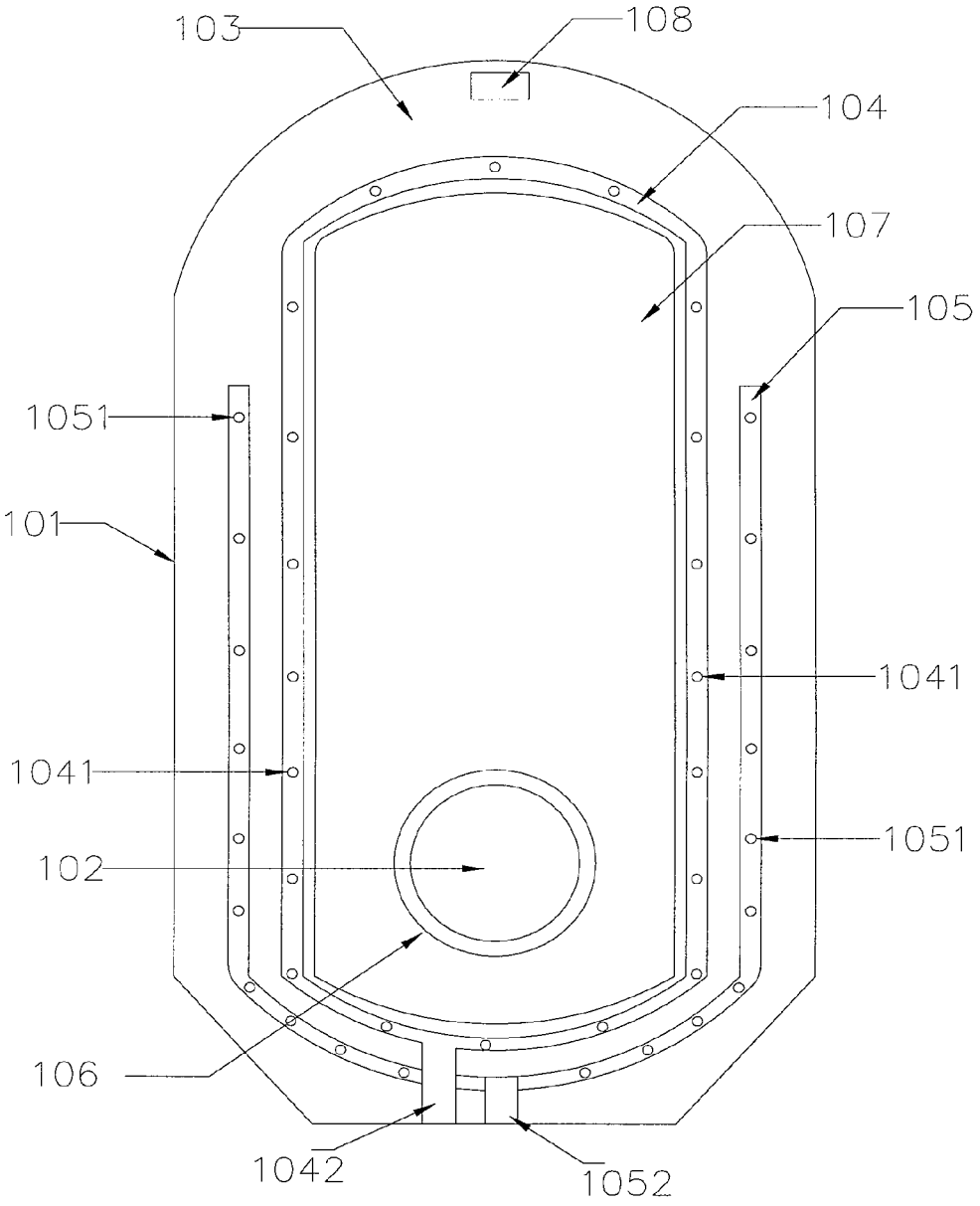
FIG. 1 is a schematic view of the sanitary ware body in the dual-pipe squatting pan according to Embodiments 1 and 2 of the present invention.
Figure 2:
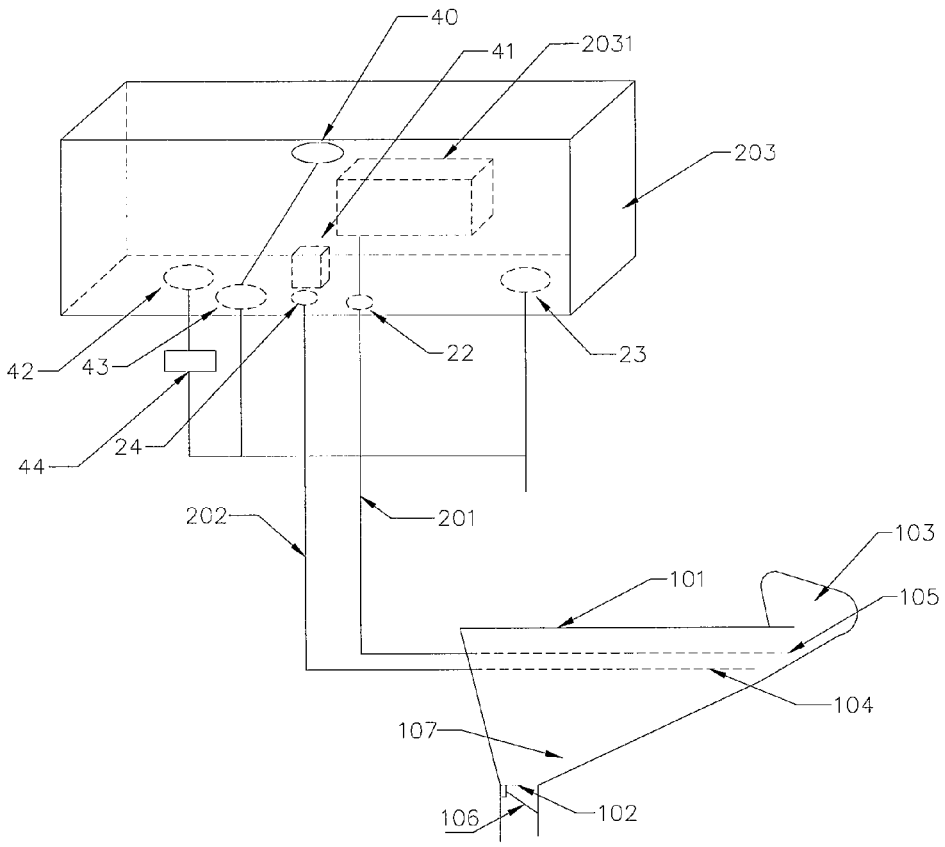
FIG. 2 is a schematic structural view of the dual-pipe squatting pan according to Embodiments 1 and 2 of the present invention.

The following discussion is presented to enable a person skilled in the art to make and use the invention. Various modifications will be readily apparent to those skilled in the art, and the general principles described herein may be applied to embodiments and applications other than those detailed below without departing from the spirit and scope of the present invention as defined herein. The present invention is not intended to be limited to the embodiments shown, but is to be accorded the widest scope consistent with the principles and features disclosed herein.

Many aspects of the invention can be better understood in the following embodiments with reference to the accompanying drawings.

Embodiment 1

Referring to FIGS. 1 to 8, a dual-pipe foam and water flushing sanitary ware mainly comprises a sanitary ware body 101, a water tank 203, a foam pipe 201 and a water supplying pipe 202. The sanitary ware body 101 is provided with a sewage cavity 107 on its bottom, and the bottom of the sewage cavity 107 is provided with a sewage draining exit 102. Inside the sanitary ware body 101, a liquid channel 104 and a foam channel 105 are provided separately without communicating with each other. The sanitary ware 101 is further provided with a water inlet 1042 and a foam inlet 1052, the water inlet 1042 is in communication with the liquid channel 104, the foam inlet 1052 is in communication with the foam channel 105. The liquid channel 104 is provided with liquid outlets 1041, while the foam channel 105 is provided with foam outlets 1051, and the liquid outlets 1041 and the foam outlets 1051 are arranged on the upper inner wall of the sewage cavity 107. In this embodiment, the liquid channel 104 and the foam channel 105 are arranged in a manner surrounding the periphery of the sanitary ware body.

A deodorizing device 106 that can be opened and closed at the sewage draining exit 102 is further provided on the bottom of the sewage draining exit 102 of the sanitary ware body 101, so that in the normal state, it can close and seal the sewage draining exit 102 to prevent the bad smell from leaking out. When an object such as excretion falls, the deodorizing device 106 is actuated to open the sewage draining exit 102 due to bearing force, so that the object falls through the sewage draining exit 102.

In the above sanitary ware, the water inlet 1042 may be connected to an external water supplying system, and the foam inlet 1052 may be connected to an external foaming system. When in use, the water of the water supplying system is supplied into the sewage cavity 107 through the liquid channel 104 to carry out the water flushing; the foam generated from the foaming system is supplied to the sewage cavity 107 through the foam channel 105 to realize the foam flushing.

In this embodiment, because the liquid channel 104 and the foam channel 105 in the sanitary ware body 101 are not communicated with each other, when in use, the water and the foam are supplied via different pipes, which avoid poor cleaning result due to the insufficient amount of foam caused when the water and the foam are supplied in one pipe. Therefore, the water and the foam are supplied in high speed, and the pipes will not be obstructed easily.

Furthermore, the channels for supplying the foam and the water are the liquid channel 104 and the foam channel 105 which are integrally formed in the sanitary ware body. Comparing with the sanitary ware with separate metal or plastic pipes in the prior art, the sanitary ware of the present invention can avoid the obstructing caused by corrosion of the pipes, and thus is more stable and has a longer lifetime.

In order to obtain a better result in water flushing, The liquid channel 104 may be designed into a loop surrounding the sewage cavity 107, and the liquid outlets 1041 are arranged evenly along the liquid channel 104, that is, each pair of the adjacent liquid outlets 1041 has the same spacing, and each liquid outlet 1041 has the same size, so that the water can flow out evenly from the periphery of the sewage cavity 107, and better cleaning result will be obtained.

Furthermore, it is found by the inventor during his research that when the foam richness reaches a certain extent, the fluidity of the foam is relatively low, and the farther is the distance of the foam away from the foam inlet 1052, the lower is the fluidity of the foam. Therefore, the foam channel 105 is arranged in U shape and the opening of the U shape is arranged at the side of the sanitary ware body 101 opposite to the foam inlet 1052, so that after the foam enters from the foam inlet 1052, the foam flow forwards along both sides of the U-shaped channel and form a return impact force when encountering with the opposite closed end, and the return impact force enables the foam to be forced out form the foam more powerfully, and the cleaning result is much more efficient as compared with the foam channel 105 in a loop design. Moreover, the spacing of the foam outlets 1051 may be different to allow the spacing to increase along the extending direction away from the foam inlet 1052. Furthermore, the size of the foam outlets 1051 may decrease as the foam outlets get close to the foam inlet 1052, that is to say, the size of the foam outlets 1051 increases along the extending direction away from the foam inlet 1052. In this way, the foam flushing of the foam having lower fluidity at the closed end of the foam channel 105 is facilitated such that the entire foam dispensing is more evenly.

In order to further improve the cleaning result of the sanitary ware, an infrared reflective plate 108 is further mounted on the inner wall of the sewage cavity 107 below the foam outlets 1051 and the liquid outlets 1041. Meanwhile, an infrared detector corresponding to the infrared reflective plate 108 is provided on other components of the sanitary ware outside the sanitary ware body such as a apparatus case, the water supplying pipe 202 or the foam pipe 201. When in use, an infrared beam is emitted by the infrared detector to the infrared reflective plate 108, and the infrared detector detects whether the infrared reflected by the infrared reflective plate 108 is received by the infrared detector, and the detected signal is transmitted to a controller 303 in the apparatus case. The controller 303 determines the current condition of the discharging of the foam according to the detected signal, in order to control the foam generation of the foaming system in the apparatus case. In particular, for the infrared reflective plate 108 being set in the sewage cavity 107, after the user has finished the using of the sanitary ware, the controller 303 controls the water tank 203 in the apparatus case to initiate the water flushing to wash away the ordure on the surface of the infrared reflective plate, while the controller 303 controls the foaming system to generate the foam, which flows through the foam pipe 201 and then the foam channel 105 and enters into the sewage cavity 107 via the foam outlets 1051. When the concentration and height of the foam reaches to a certain level, the infrared beam emitted by the infrared detector is affected by the foam on the surface of the infrared reflective plate 108 and thus can not be reflected by the infrared reflective plate 108 back to the infrared detector. When the infrared detector does not receive the reflected infrared beam, this detected condition is sent to the controller 303 which then determines the current foam height has reached a predetermined effect and stops the operation of the foaming system; in contrary, when the infrared detector receive the reflected infrared beam, this detected condition is sent to the controller 303 which in turn determines the foam height is insufficient and then controls the foaming system to generate more foam to obtain a better cleaning result. Therefore, the cleaning result is automatically controlled.

As an illustrative example, the foaming system in this embodiment mainly comprises a liquid tank 301, an air pump 306 and a foaming tank 302. The liquid tank 301 has a first air transportation pipe connected to the air pump, and also has an outlet connected to the foaming tank 302 through a liquid pipe. The liquid pipe is provided with an adjusting valve for regulating the flow and a check valve that for enabling the foam to flow in a single direction to the foaming tank 302 without flowing back to the liquid tank 301. When in use, the adjusting valve can be regulated to control the foam liquid flowing towards the foaming tank 302. An aerator 1020 is provided inside the foaming tank 302, and a water inlet is provided on the foaming tank 302.

The aerator 1020 (also indicated as 38 in FIG. 3) has an air intake pipe connected to an air inlet 308 on the foaming tank 302. The air inlet 308 is connected to the air outlet of the air pump through the first air transportation pipe. The water inlet 1042 of the sanitary ware body 101 is connected to the water tank 203 via the water supplying pipe 202, and an electromagnetic valve electrically connected to the controller 303 is set on the water supplying pipe 202. The foam outlet of the foaming tank 302 is connected to the foam inlet 1052 of the sanitary ware body 101 through the foam pipe 201. When in use, the foam liquid is transported to the foaming tank 302 by the liquid tank 301 via the liquid transportation pipe, the water tank 203 supplies water to the foaming tank via the water inlet 3052 of the water supplying pipe 202, and the air pump supplies air to the aerator 1020 (also indicated by 38 in FIG. 3), the aeration of the aerator 1020 enables the mixture of the foam liquid and the water to have plentiful foam, and the foam flows through the foam channel 105 in the sanitary ware body 101 and is discharged via the foam outlets 1051.

In order to further improve the automatic flushing result of the sanitary ware, an infrared sensor 320 for detecting whether the sanitary ware is being used is mounted on the apparatus case, the water supplying pipe or the foam pipe. The infrared sensor 320 is connected to the controller 303, so that the detected signal is transmitted to the controller 303. When the controller 303 determines that the user has finished using the sanitary ware according the detected signal of the infrared sensor 320, the water tank 203 is controlled by the controller 203 to actuate the water flushing, and then the foaming system is controlled by the controller to dispense the foam for cleaning.

In this embodiment, the deodorizing device may be a magnetic assistant sealing device or a single mechanical sealing device. In this embodiment, a rotatable-plate sealing device without the assistant of magnetic force is used to prevent the harmful air from escaping out from the sewage draining passage below the sewage draining exit of the sanitary ware and also to prevent the metal members from affecting the magnetic sealing.

Figure 5:
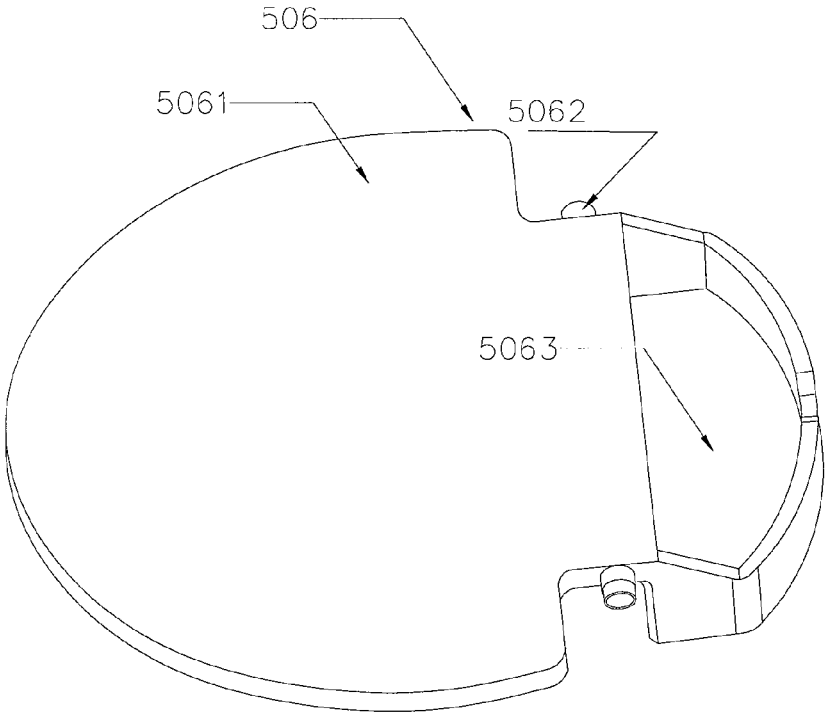
FIG. 5 is a schematic view of a deodorizing device in the dual-pipe sanitary ware according to Embodiments 1 and 2 of the present invention.
Figure 6:
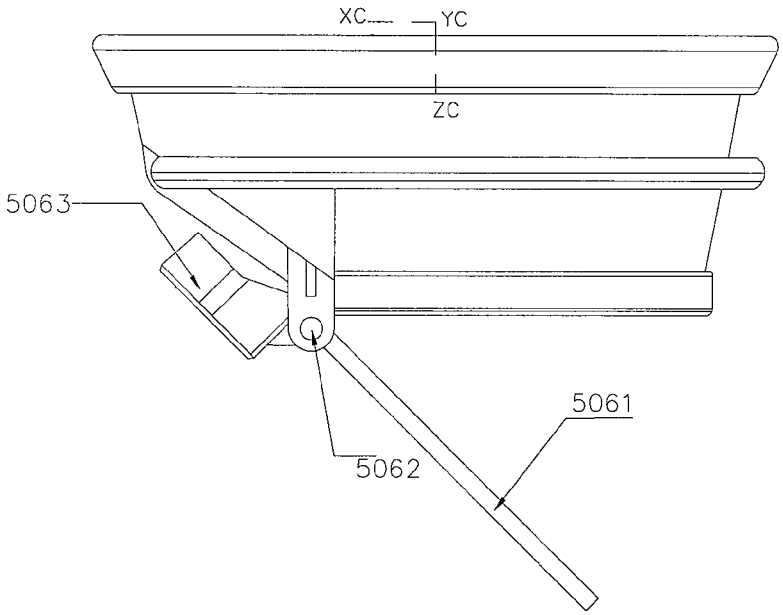
FIG. 6 is a schematic view illustrating the connection between a sewage draining exit and a deodorizing device in the dual-pipe sanitary ware according to Embodiments 1 and 2 of the present invention.

Referring to FIGS. 5 and 6, as an illustrative example, a deodorizing device 506 comprises a rotatable plate 5061 that is connected to the bottom of the sewage draining exit 102 by the pin 5062 and rotatable with respect to a pin 5062 to realize the opening and closing of the sewage draining exit 102. A counterweight (not shown, mounted on a rotation platform 5063) is fixed on an end of the rotatable plate 5061 away from the sewage draining exit 102. In this manner, under the normal state, the rotatable plate 5061 seals the bottom of the sewage draining exit 102 horizontally due to the weight of the counterweight on one side of the pin 5062, which realizes the physical sealing. This further improves the result of preventing the air from escaping out, in addition to the obstruction to the air by the foam. If a sewage is dropped into the sewage cavity 107, the rotatable plate 5061 is rotated around the pin 5062 because of the weight of the sewage on the rotatable plate 5061, as a result, the sewage falls into the sewage draining passage, and then the rotatable plate 5061 is returned to the horizontal position to seal the sewage draining exit due to the weight of the counterweight.

It can be seen from the above description that the deodorizing device 506 is in a simple structure and seals the sewage draining exit 102 effectively in addition to the obstruction to the air by the foam. The sealing and the sanitation effects are improved accordingly.

It should be noted that the above structure may also be used in the sitting Water-Closet pan or in the squatting pan.

Embodiment 2

Referring to FIGS. 1 to 4, a structure of a dual-pipe foam and water flushing type squatting pan utilizing the above structure is schematically illustrated.

The squatting pan comprises a sanitary ware body 101, a water tank 203, a foam pipe 201 and a water supplying pipe 202. The sanitary ware body 101 is provided with a sewage cavity 107 on its bottom. The bottom of the sewage cavity 107 has a sewage draining exit 102 at one end, and a head portion 103 at the opposite end. A liquid channel 104 and a foam channel 105 are provided inside the sanitary ware body 101. The liquid channel 104 has liquid outlets 1041, and the foam channel 105 has foam outlets 1051. In this embodiment, the liquid channel 104 and the foam channel 105 are arranged in a manner surrounding the periphery of the sanitary ware body 101. A water inlet 1042 and a foam inlet 1052 are arranged at the end of the sanitary ware body 101 where the sewage draining exit 102 is located. The water inlet 1042 and the foam inlet 1052 are connected to the water pipe 202 and the foam pipe 201, respectively.

Furthermore, the sewage draining exit 102 of the sanitary ware body 101 is provided with a deodorizing device 106 which may be a magnetic assistant sealing ring or a mechanical sealing ring. In this embodiment, a rotatable-plate sealing ring is used to prevent the harmful air from escaping out.

The spacing of the foam outlets 1051 along the foam channel 105 decreases from the sewage draining exit 102 to the head portion 103. The liquid outlets 1041 can be arranged evenly on the liquid channel 104 or only around the sewage draining exit 102 and the head portion 103. The liquid channel 104 forms a loop surrounding the sewage draining exit 102, while the foam channel 105 is in U shape extending from the sewage draining exit 102 to the head portion 103 and the opening of the U shape is located at the head portion 103 of the sanitary ware body 101. An infrared reflective plate 108 is arranged on the bottom of the sanitary ware body 101, and the infrared reflective plate 108 is used in detecting the height of the foam within the sanitary ware body 101 that is discharged from the foam channel 105. When the height of the foam is insufficient, the foam is supplemented until the height of the foam reaches a desired value.

In the water tank 203 (also called as the apparatus case), a foaming system, a foam outlet 22, a water inlet 23, a water outlet 24, an electromagnetic water inlet 42, an emergency flushing valve water inlet 43, an emergency flushing valve 40 and an automatic draining device 41 are provided. The foam outlet 22 is connected to a foaming device 2031, the water inlet 23 is connected to the water source, the foam pipe 201 is connected to the foam channel 105 and the foam outlet 22, the water supplying pipe 202 is connected to the water outlet 24 and the water channel 104, the water outlet of the electromagnetic valve 44 and the water outlet of the emergency flushing valve 40 are connected to the draining device 41.

Figure 3:
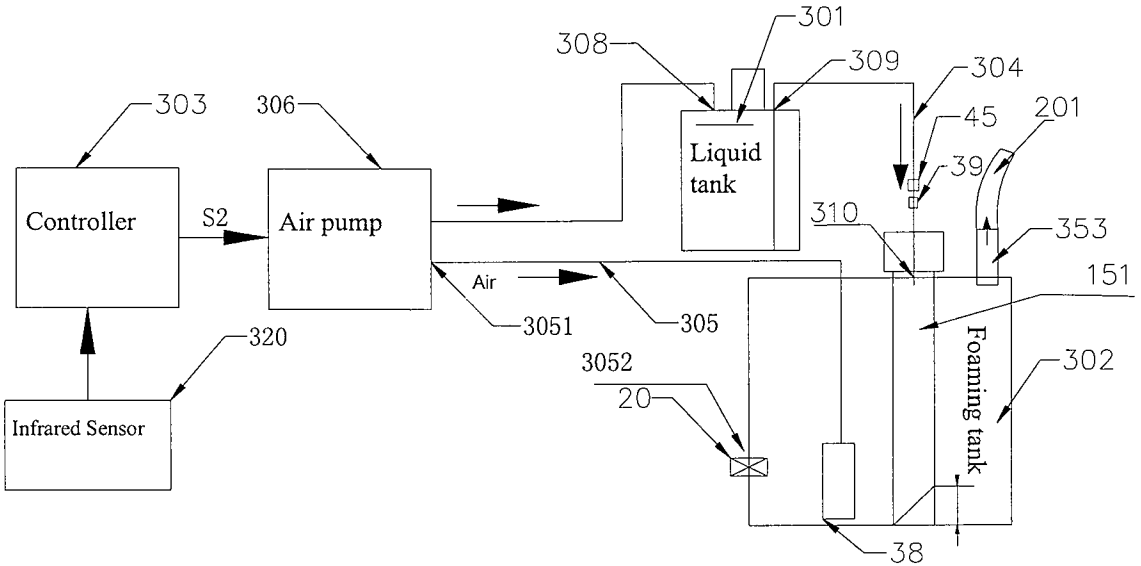
FIG. 3 is a schematic view of a foaming system in the dual-pipe squatting pan according to Embodiments 1 and 2 of the present invention.

Referring to FIG. 3, the foaming system comprises an infrared sensor 320, a controller 303, an air pump 306, a liquid tank 301, a foaming tank 302, a first connecting pipe 304 and a second connecting pipe 305. The infrared sensor 320 are provided on the water tank (not shown) and the middle of the bottom of the water tank cylinder, to detect the foam height signal in the sanitary ware and the water level signal in the water tank and to send out a signal S1. After the detected signal S1 is received by the controller 303, the controller 303 sends out a control signal S2 to the air pump 306 which thus generates air flow. The foam liquid concentrate is stored in the liquid tank 301. The liquid tank 301 has a foam outlet 309 and an air inlet 308 connected to the air pump 306. The foaming tank 302 has a foam liquid concentrate inlet 310, a water inlet 3052 and a foam outlet 353, the water inlet 3052 is communicated with the water tank 203, and the foam outlet 353 is connected to the foam pipe 201. The first connecting pipe 304 is connected to the foam outlet 309 and the foam liquid concentrate inlet 310, and the first connecting pipe extends through the inlet 310 and forms a gap with the bottom of the foaming tank 302. The second connecting pipe 305 has an end 3051 connected with the air pump 306 and the other end 3052 connected with the foaming tank 302, and the end connected with the foaming tank 302 extends to the bottom of the foaming tank 302 and is provide with an aerator 38.

Figure 4:
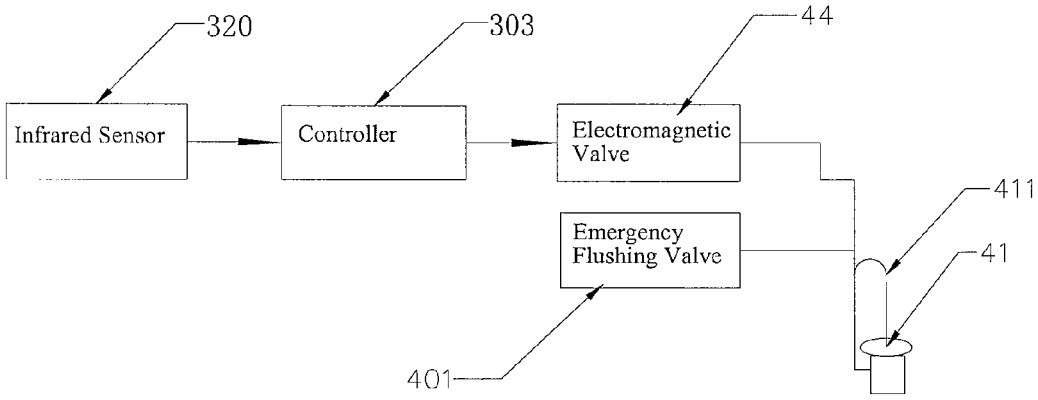
FIG. 4 is a schematic view of an automatic flush device in the dual-pipe squatting pan according to Embodiments 1 and 2 of the present invention.

As shown in FIG. 4, an automatic water flushing device comprises an infrared sensor 320, a controller 303, an electromagnetic valve 44, and an automatic draining device 41. The infrared sensor 320 (e.g., tri-linear infrared sensor) is provided at the middle of the water tank cylinder to detect the using of the squatting pan by a user. The controller 303 receives the detected signal and then sends out a control signal to actuate the electromagnetic valve 44. The siphon of the automatic draining device 41 is connected to the water outlet of the electromagnetic valve 44.

An emergency water flushing device comprises an emergency flushing valve 40 and an automatic draining device 41, and the water outlet of the emergency flushing valve 40 is connected to the siphon of the draining device 41.

In this embodiment, a check valve 20 is provided in the water inlet 3052. An adjusting valve 39 and a check valve 45 are arranged in the first connecting pipe 304. The siphon of the automatic draining device 41 is connected to the water outlet of the electromagnetic valve 44 and the water outlet of the emergency flushing valve 40. The controller may be an AT89S52 single-chip, the principle of which is publicly known in the art and thus will not be described in further details here.

In this embodiment, the foaming tank 302 is of a height of 320 mm. The gap between the first connecting pipe 304 and the bottom of the foaming tank 302 is 20 mm. The gap between the water inlet and the bottom of the foaming tank 302 is 30 mm.

When in use, if the using of the squatting pan by a user is detected, the controller 303 receives the detected signal and sends out a control signal to actuate the electromagnetic valve 44 to inject water into the siphon of the automatic draining device 41, and when the water flushing is finished, the water inlet 23 starts to supply water, and the foaming system starts working to supply the sanitary ware with foam. For example, if the water tank 203 is full of water and no foam is contained in the sanitary ware body 101, the detected signal S1 will be sent to the controller 303. The controller 303 sends out a control signal S2 to actuate the air pump 306 according to the received signal S1. In this embodiment, the air outlet of the air pump 306 is connected to a six-port valve such that eight air outlets are obtained, and the air flows are transmitted to the liquid tank 301 and the foaming tank 302 respectively, and one air flow orifice is a decompression orifice. The foam liquid concentrate in the liquid tank 301 is forced into the foaming tank 302 through the first connecting pipe 304 under the pressure of air flow. Because the water tank 203 is full of water and the foaming tank 302 is communicated with the water tank 203 via the check valve 20, the foaming tank 302 will be injected with water. In this way, under the operation of the aerator 1020 (also indicated by 38 in FIG. 3), the foam liquid concentrate is mixed with the water to obtain a liquid mixture having a large amount of foam. The foam is forced out through the foam pipe 201 from the foam outlet 353 of the foaming tank 302. After flushing, the water level in the water tank 203 drops, the controller 303 will stop the working of the air pump 306 according to the signal received from the infrared sensor 320, thereby the liquid filling and the foaming steps are stopped.

Furthermore, an adjusting valve 39 for regulating the injection amount of the foam liquid concentrate and a check valve 45 are provided in the first connecting pipe 304. For the amount of water supplied to the foaming tank 302 through the check valve 20 to be constant, the concentration of the mixture of the foam liquid concentrate and the water can be regulated such that the foam size can be adjusted.

Then, the foam generated are transmitted to the foam channel 105 in the sanitary ware body 101 through the foam pipe 201, and then exit from the foam outlets 1051 to cover the sanitary ware body 101, such that the deodorization and anti-splash effects can be realized. In this embodiment, the liquid channel 104 and the foam channel 105 are ceramic structures integrally formed in the sanitary ware body 101, thus the obstruction of the pipelines will not occur, and the foam and the liquid come out quickly.

In conclusion, the present invention has the advantages that: the foam and the liquid come out quickly, the foam is evenly distributed, and the obstruction of the pipelines will not occur easily. The foam is generated automatically and the foam liquid concentrate is also automatically supplied to the foaming tank according to the water level. Thus, the economic benefit is improved.

Embodiment 3

Figure 7:
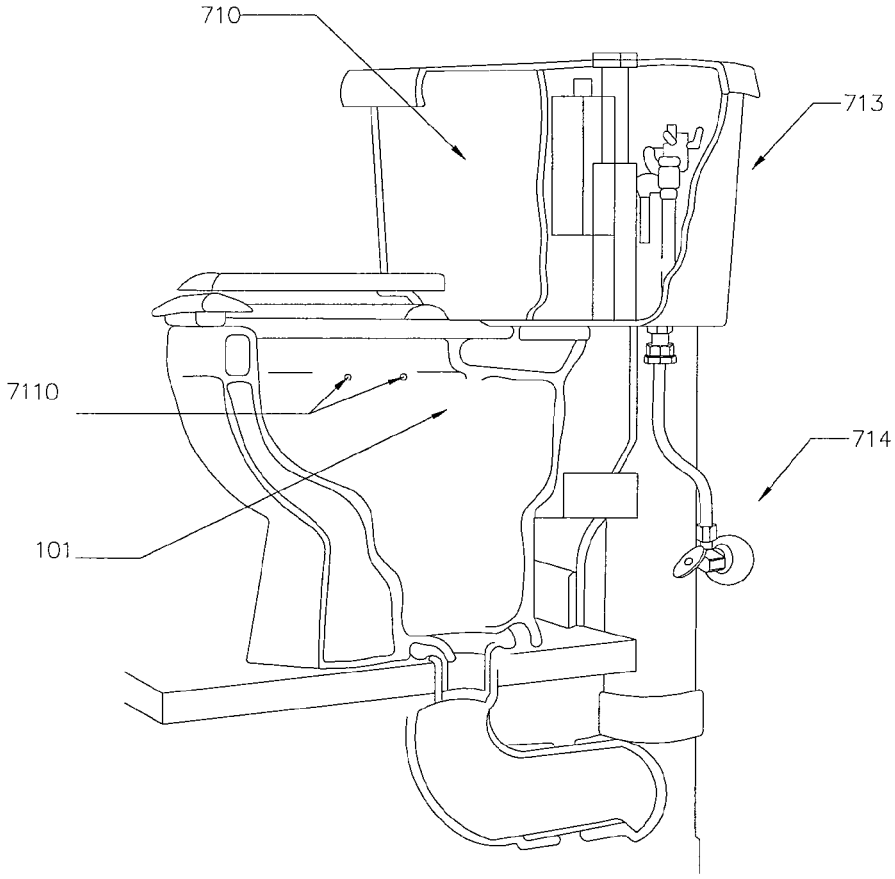
FIG. 7 is a schematic view of the dual-pipe sitting w.c. pan according to Embodiments 1 and 3 of the present invention.
Figure 8:
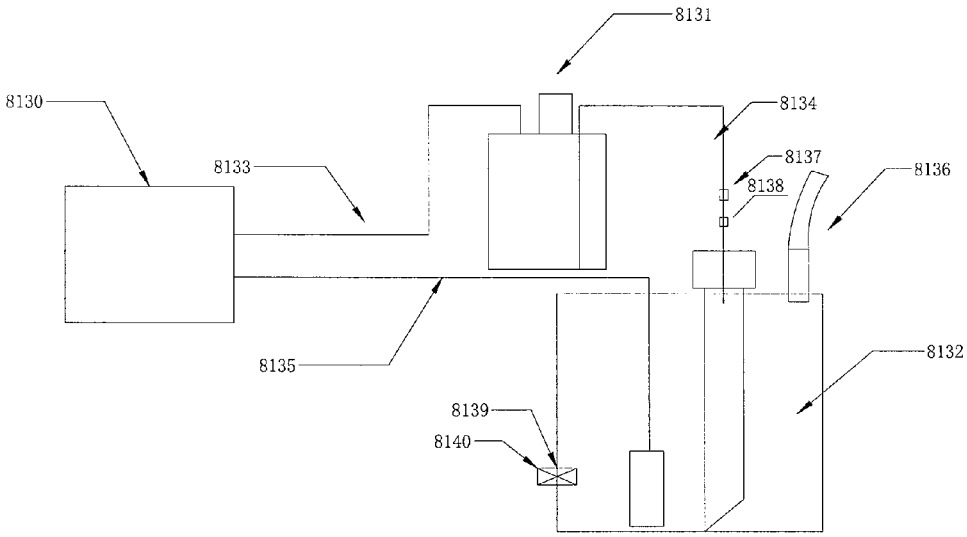
FIG. 8 is an operation diagram of the foaming unit in the dual-pipe sitting w.c. pan according to Embodiments 1 and 3 of the present invention.

Referring to FIGS. 7 and 8, an automatic foam-flushing sitting w.c. pan using the structure in the Embodiment 1 is shown.

The sitting w.c. pan comprises a water tank 710, a sitting w.c. pan body 101, a liquid level sensor 712 in the water tank (not shown), a foaming unit 713 and a controller 714. The controller 714 is set at the rear bottom portion of the sitting w.c. pan.

As shown in FIG. 8, the foaming unit 713 comprises an air pump 8130, a liquid tank 8131 and a foaming tank 8132. The outlet end of the air pump 8130 is connected to a four-port valve such that one air outlet is changed into three.

In particular, the liquid tank 8131 is filled with 600*m*1 of foam liquid, the liquid tank has an inlet connected to the air pump 8130 via a first air transportation pipe 8133, and also has an outlet connected to the foam tank 8132 through the liquid pipe 8134 in which a check valve 8138 and an adjusting valve 8137 are arranged in sequence. The adjusting valve 8137 is used for regulating the flow, and the check valve 8138 is used for enabling the foam to flow in a single direction to the foaming tank 8132 without flowing back to the liquid tank 8131. The adjusting valve 8137 can be regulated to control the amount of foam liquid per minute.

The foaming tank 8132 is provided at the top with an inlet connected to the air pump 8130 via a second air transportation pipe 8135 and an outlet connected to the sitting w.c. pan body 101 via the foam outlet pipe 8136 as shown in FIG. 7. The sitting w.c. pan body 101 has a foam outlet (not shown, but may be similar to the structure in FIG. 1) communicated with the foam outlet pipe 8136.

The foaming tank 8132 has on the bottom a water inlet 8139 connected to the water tank 710 via a check valve 8140, thereby the water can be transmitted to the foaming tank 8132 but can not flow back to the water tank 710. In this embodiment, the outlet end of the second air transportation pipe 8135 is also connected to the foaming tank 8132 via a check valve.

The working process of the foaming system 713 will be explained hereinafter. An air flow generated by the air pump 8130 passes through the four-port valve, then one way of the air flow is transmitted to the liquid tank 8131 via the first air transportation pipe 8133, and another way of the air flow is transmitted to the foaming tank 8132 via the second air transportation pipe 8135. The foam liquid is mixed with water in the foaming tank 8132, and under the air pressure, foam is generated. The foam is transmitted to the sitting w.c. pan body 101 via the foam outlet pipe 8136.

Embodiment 4

This embodiment is a dual-pipe sanitary ware for urinating utilizing the structure similar to that in the Embodiment 1.

Figure 9:
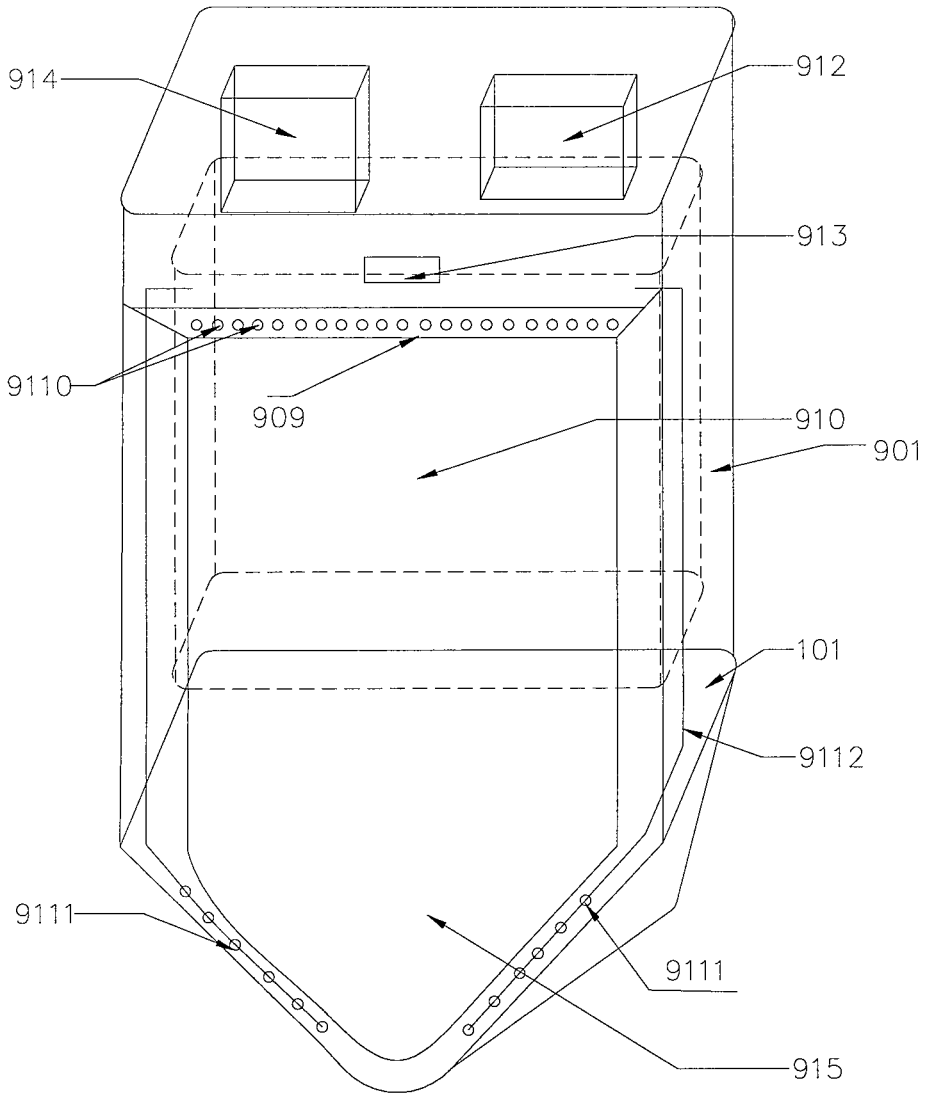
FIG. 9 is a schematic diagram of a dual-pipe sanitary ware for urinating according to Embodiment 4 of the present invention.
Figure 10:
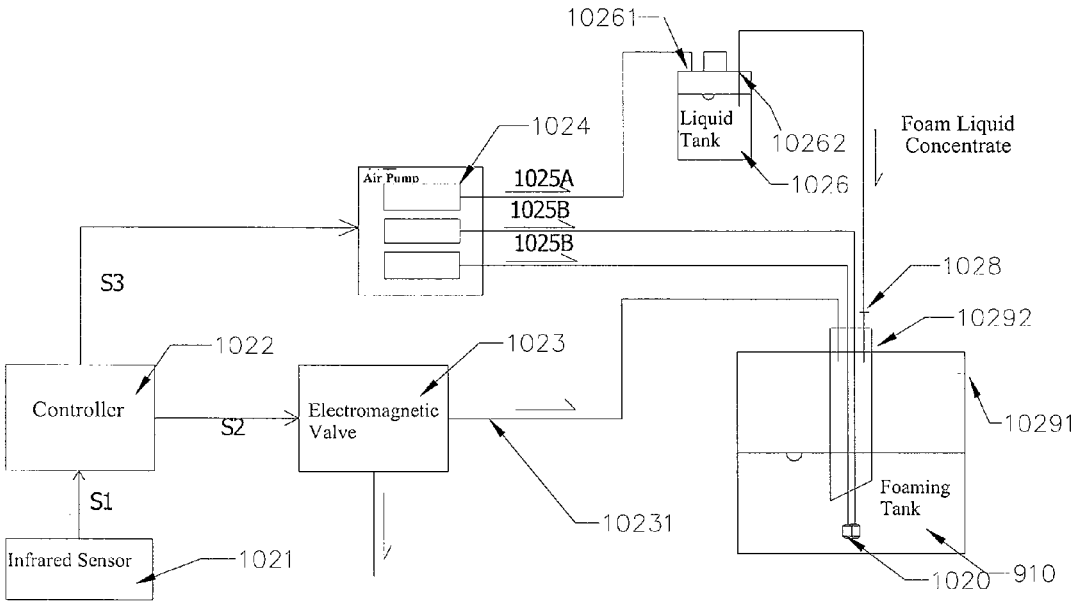
FIG. 10 is a schematic diagram of the foaming unit in a dual-pipe sanitary ware for urinating according to Embodiment 4 of the present invention.

Referring to FIGS. 9 and 10, the sanitary ware for urinating comprises a sanitary ware body 101 which is provided with a sewage cavity 901 and a foaming tank 910. The sewage cavity 901 is arranged at the front bottom of the sanitary ware body 101, while the foaming tank 910 is arranged in the rear portion of the sewage cavity 901.

The sewage cavity 901 is provided inside with a foam channel 9112 communicated with the foam outlet of the foaming tank 910. The foam channel 9112 extends to a bottom trough 915 along the two sides of the sewage cavity 901. The foam channel 9112 has foam outlets 9111 around the bottom trough 915 and located at the inner wall of the bottom trough 915.

The sewage cavity 901 is provided on the top with a transversal liquid channel 909, and the liquid channel 909 has water outlets 9110 on the inner wall of the sewage cavity 901.

The foaming tank 910 is connected with a foaming system 912, an infrared detector 913 and a controller 914. foaming system 912, the controller 914 and the foam channel 9112 of the foaming system 912 are all arranged in the sanitary ware for urinating.

As shown in FIG. 10, the foaming system 912 comprises air pumps 1024 (three in total), the liquid tank 1026 and the foaming tank 910. The outlet ends of two air pumps 1024 are connected to the two plastic air ports of a four-port plug 10292 on the foaming tank 910.

In particular, the liquid tank 1026 contains about 600*m*1 of the foam liquid concentrate. An inlet 10261 of the liquid tank is connected with one air pump 1024 via a first air transportation pipe 1025A, while an outlet 10262 is connected with a first liquid transportation pipe 1027 and connected to one air port of the four-port plug 10292 of the foaming tank 910 via an adjusting valve, so that the amount of foam liquid per minute can be controlled by the adjusting valve 1028.

The four-port plug 10292 is mounted on the foaming tank 910, and the foam is transmitted to the bottom trough 915 via an outlet 10291 on the top of the foaming tank 910 and the foam channel 9112, as shown in FIG. 9. Two air ports of the four-port plug 10292 are connected to the air pump 1024 by two second air transportation pipes, respectively.

The four-port plug 10292 has an automatic water filling port which is connected to an electromagnetic valve 1023 via a second liquid transportation pipe 10231 so as to ensure the appropriate water amount in the foaming tank 910.

The working process of the foaming system 912 will be described hereinafter. One way of the air flow generated by the air pump 1024 is transmitted into the liquid tank 10261 through the first air transportation pipe 1025A. The other two ways of the air flow are respectively transmitted by the second air transportation pipes 1025B (two pipes) to the four-port plug, and extend to the bottom of the foaming tank and to two aerators 1020 (also indicated by 38 in FIG. 3); the foam liquid concentrate in the liquid tank 1026 is transmitted to the foaming tank 910 by air pressure. The foam liquid concentrate in the foaming tank 910 is mixed with water to generate foam under the operation of the aerators 1020, and the foam is transmitted to the bottom trough 915 of the sanitary ware body 101 through the outlet 10291 on the top of the foaming tank, as shown in FIG. 9.

When in use, an infrared sensor 1021 sends out a detected signal S1 to the controller 1022 upon detecting that the user has finished using the sanitary ware for urinating, and then the controller 1022 sends out a signal S2 to actuate the opening of the electromagnetic valve 1023 such that the flushing of the sanitary ware for urinating is performed, meanwhile the foaming tank 910 is supplemented with water automatically via the second liquid transportation pipe 10231; when the flushing is actuated, the controller 1022 sends out a signal S3 to the foaming system 912, air flow is generated by the air pump 1024 after delaying and transmitted to the foaming system 912 to generate the foam which are transmitted to the bottom trough 915 via the foam channel 9112 in the sanitary ware for urinating. The deodorization and cleaning results are thus obtained.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

What is claimed is:

1. A sanitary ware, comprising:

a sanitary ware body including a sewage cavity at the bottom of the sanitary ware body, and a sewage draining exit on the bottom of the sewage cavity;

a liquid channel and a foam channel that are not in communication with each other are included on the sanitary ware body, and the liquid channel and the foam channel are ceramic structure integrally formed in the sanitary ware body;

the sanitary ware body further including a water inlet and a foam inlet, the water inlet being in communication with the liquid channel, and the foam inlet being in communication with the foam channel;

the liquid channel including liquid outlets, and the foam channel including foam outlets, the liquid outlets and the foam outlets being arranged on the upper inner wall of the sewage cavity; and a deodorizing device adapted to be closed and opened at the bottom of the sewage draining exit, wherein an infrared reflective plate is further mounted on the inner wall of the sewage cavity below the foam outlets and the liquid outlets;

the sanitary ware has an apparatus case in which a controller, a foaming system for generating foam and a water tank are mounted, with a water supplying pipe connecting the water tank and the water inlet;

the sanitary ware further including an infrared detector for sending an infrared beam to the infrared reflective plate and detecting whether the infrared beam reflected back by the infrared reflective plate is received; and the controller is electrically connected to the infrared sensor, and when the infrared beam reflected back is received by the infrared sensor, the foaming system is driven by the controller to supplementing foam.

2. The sanitary ware of claim 1, wherein the liquid channel is arranged to surround the periphery of the sewage cavity, and the liquid channel is evenly provided with liquid outlets.

3. The sanitary ware of claim 1, wherein the foam channel is arranged in U shape surrounding the sewage cavity, and the opening of the U shape is arranged at the side opposite to the foam inlet.

4. The sanitary ware of claim 1, 2, or 3, wherein the size of the foam outlets decreases as the foam outlets get close to the foam inlet.

5. The sanitary ware of claim 1, 2, or 3, wherein the spacing of the foam outlets is so that the spacing increases along the extending direction away from the foam inlet.

6. The sanitary ware of claim 1, 2, or 3, wherein the liquid outlets arranged evenly along the liquid channel.

7. The sanitary ware of claim 1, 2, or 3, wherein the foam outlets have the same size.

8. The sanitary ware of claim 1, wherein the foaming system comprises a liquid tank, an air pump and a foaming tank;

wherein the liquid tank has a first air transportation pipe connected to the air pump, and has an outlet connected to the foaming tank through a liquid transportation pipe, and the liquid transportation pipe includes an adjusting valve for regulating the flow and a check valve;

the foaming tank includes an aerator inside, the aerator having an air intake pipe connected to an air inlet that is on the foaming tank and connected to an air outlet of the air pump through an air transportation pipe; the foaming tank has a water inlet connected to the water tank through a water supplying pipe; and the foaming tank is further includes a foam outlet that is connected to the foam inlet on the sanitary ware through the foam pipe.

9. The sanitary ware of claim 1, wherein an infrared sensor for sensing whether the sanitary ware is being used is mounted on the apparatus case, the water supplying pipe, or the foam pipe; the infrared sensor being connected to the controller, and signals detected by the sensor being transmitted to the controller.

10. The sanitary ware of claim 1, 2, or 3, wherein the deodorizing device is a rotatable plate that is connected to the bottom of the sewage draining exit by a pin and rotatable with respect to the pin to realize the opening and closing of the sewage draining exit; and a counterweight is fixed on an end of the rotatable plate away from the sewage draining exit.

11. The sanitary ware of claim 1, 2, or 3, wherein the sanitary ware is a squatting pan or a sitting w.c. pan.

12. A sanitary ware for urinating, comprising:

a sanitary ware body, wherein the sanitary ware body including a sewage cavity and a foaming tank, the sewage cavity being arranged at the front bottom of the sanitary ware body, and the foaming tank being arranged in the rear portion of the sewage cavity;

the sewage cavity including a foam channel inside in communication with the foam outlet of the foaming tank, the foam channel extending to a bottom trough along both sides of the sewage cavity, and the foam channel having foam outlets around the bottom trough and being located at the inner wall of the bottom trough; and the sewage cavity including a transversal liquid channel on the top, and the liquid channel has water outlets on the inner wall of the sewage cavity, wherein the sanitary ware body further includes an apparatus case on the top, and a controller, an air pump and a liquid tank are mounted in the apparatus case;

a liquid inlet of the foaming tank is connected to the liquid tank through a first liquid transportation pipe, and a check valve and an adjusting vale for regulating the foam flow are included in the first liquid transportation pipe;

the foaming tank included an aerator inside, the aerator having an air intake pipe connected to an air inlet that is on the foaming tank and connected to an air outlet of the air pump through an air transportation pipe; and the foaming tank has a water inlet connected to the water tank through a water supplying pipe, and an electromagnetic valve is mounted on the water supplying pipe and electrically connected to the controller.

13. The sanitary ware for urinating of claim 12, wherein an infrared sensor for sensing whether the sanitary ware is being used is mounted on the apparatus case; and the infrared sensor is connected to the controller, and signals detected by the sensor are transmitted to the controller.

* * * * *